US010988958B2

(12) United States Patent
Newman

(10) Patent No.: US 10,988,958 B2
(45) Date of Patent: Apr. 27, 2021

(54) ROTATING PIN KEY LOCK

(71) Applicant: Marc Alan Newman, Tempe, AZ (US)

(72) Inventor: Marc Alan Newman, Tempe, AZ (US)

( * ) Notice: Subject to any disclaimer, the term of this patent is extended or adjusted under 35 U.S.C. 154(b) by 402 days.

(21) Appl. No.: 16/220,677

(22) Filed: Dec. 14, 2018

(65) Prior Publication Data

US 2020/0190852 A1 Jun. 18, 2020

(51) Int. Cl.
*E05B 27/00* (2006.01)
*E05B 35/00* (2006.01)

(52) U.S. Cl.
CPC ..... *E05B 27/0021* (2013.01); *E05B 27/0039* (2013.01); *E05B 35/003* (2013.01)

(58) Field of Classification Search
CPC .. E05B 27/00; E05B 27/0021; E05B 27/0039; E05B 35/003
USPC ..... 70/493–496, 356
See application file for complete search history.

(56) References Cited

U.S. PATENT DOCUMENTS 2,491,337 A * 12/1949 Segal ..... E05B 27/00 70/419
4,094,175 A * 6/1978 Pechner ..... E05B 27/005 70/383
4,235,086 A * 11/1980 Genakis ..... E05B 27/0039 70/378
4,262,505 A * 4/1981 Moscatelli ..... E05B 27/00 70/358
4,942,749 A * 7/1990 Rabinow ..... E05B 29/004 70/383
4,998,426 A * 3/1991 Genakis ..... E05B 27/0039 70/494
5,457,974 A * 10/1995 Keller ..... E05B 35/003 70/358
6,257,033 B1 * 7/2001 Ziv-Av ..... E05B 27/0021 70/409
6,634,197 B2 * 10/2003 Widen ..... E05B 9/086 70/337
6,748,777 B1 * 6/2004 Livingston ..... E05B 9/086 70/369
8,490,446 B2 * 7/2013 Rao ..... E05B 29/0013 70/383
8,534,102 B2 * 9/2013 Andersson ..... E05B 47/063 70/278.7
8,621,902 B2 * 1/2014 Mathachan ..... E05B 27/005 70/492
10,472,856 B1 * 11/2019 Widen ..... E05B 27/0078
10,876,322 B2 * 12/2020 Yoshida ..... E05B 19/0052
2005/0172686 A1 * 8/2005 Yu ..... E05B 27/0007 70/358

(Continued)

*Primary Examiner* — Suzanne L Barrett
(74) *Attorney, Agent, or Firm* — James L Farmer

(57) ABSTRACT

Provided is a key lock operable for locking and unlocking a latch control mechanism. The key lock includes a key collar with a front face, an outer cylindrical surface, and a longitudinally extending key slot. A center collar is concentrically disposed about the key collar such that an inner cylindrical surface of the center collar is fit to and rotatable on the outer cylindrical surface of the key collar. A series of cylindrical rotating pins are disposed in the center collar, each rotating pin having a notch with a key ID surface configured to engage one of a corresponding series of ID cut surfaces of a key when the key is inserted in the key slot and rotated to a key verification position, thereby rotationally orienting each pin at a respective ID position.

22 Claims, 11 Drawing Sheets

(56) References Cited

U.S. PATENT DOCUMENTS

2008/0314106 A1* 12/2008 Mathachan ..... E05B 27/0082
70/493
2018/0298644 A1* 10/2018 Vornbrock ..... E05B 17/047

* cited by examiner

Fig. 9
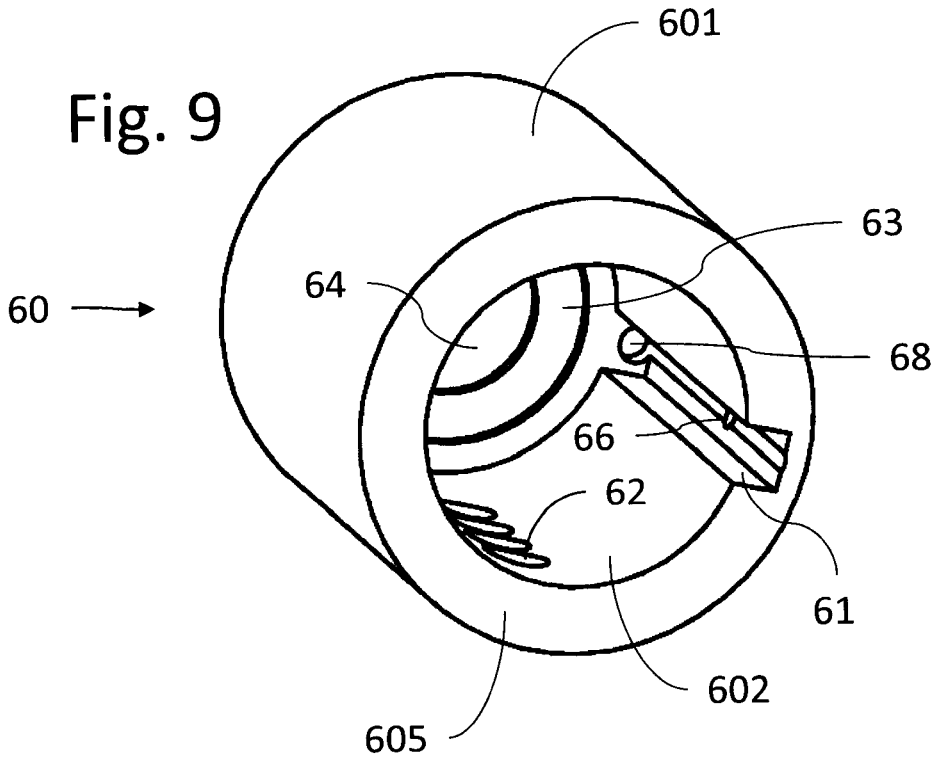
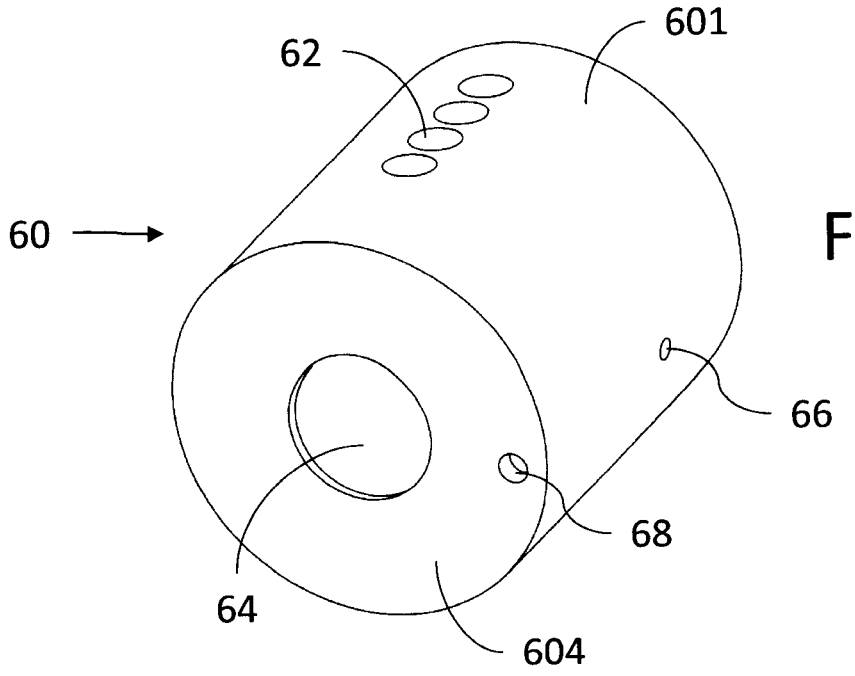
Fig. 10

Fig. 11
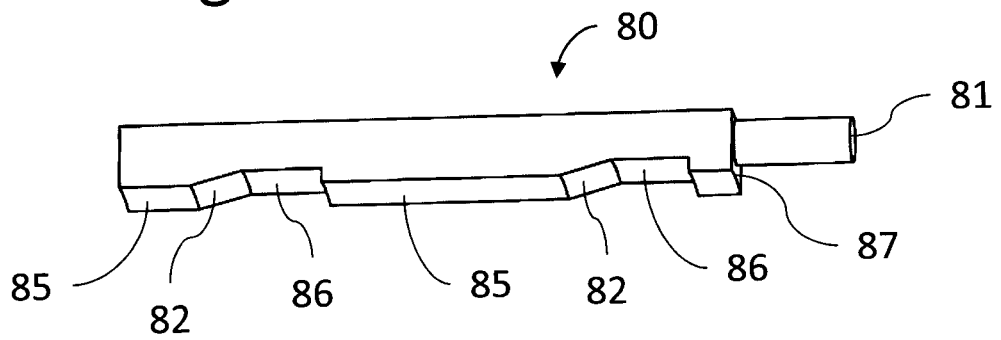
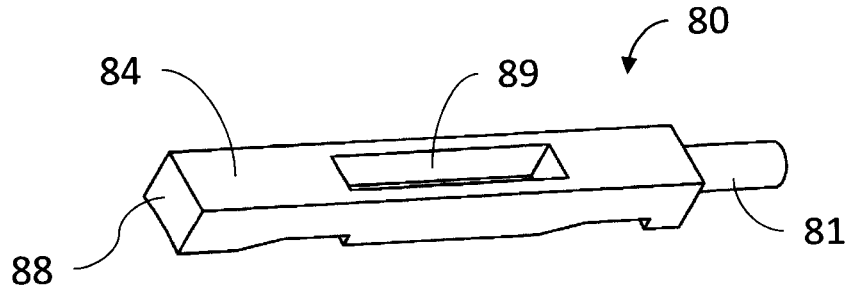
Fig. 12

ROTATING PIN KEY LOCK

TECHNICAL FIELD AND BACKGROUND

The technical field of the present invention relates to methods and apparatus for locking and unlocking. The technical field may more specifically relate to the use of key operated locks.

BRIEF DESCRIPTION OF THE DRAWINGS

In the accompanying drawings:

FIG. 2 is an exploded perspective view of the rotating pin key lock shown in

FIG. 1;

FIGS. 9 and 10 are perspective back and front views respectively of the outer collar;

FIGS. 11 and 12 are bottom and top perspective views of the key release controller;

DESCRIPTION OF THE EMBODIMENTS

Figure 1:
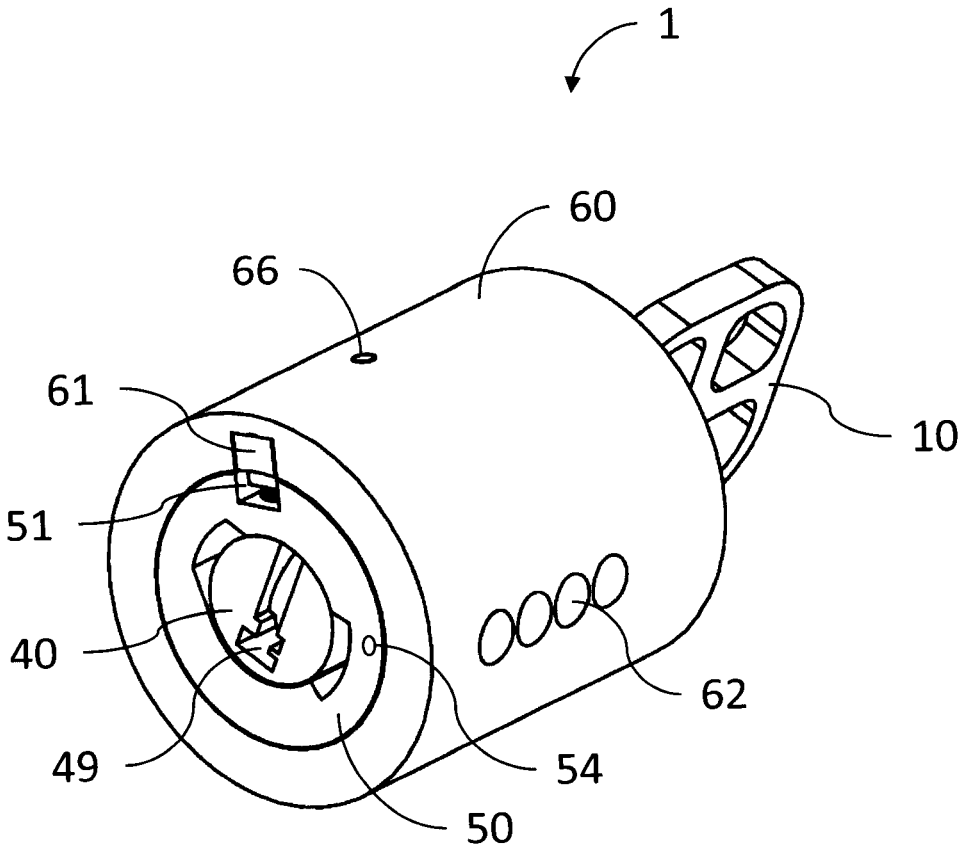
FIG. 1 is perspective view of the rotating pin key lock in accordance with the present disclosure.

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

A key, as that term is used herein, is a user held device that is partially inserted into a lock and rotated in order to lock or unlock. Electronic, dial combinations, and other kinds of keys are not addressed or relevant to this invention.

The lock identification, or ID, is the pattern cut into the key that allows one key to be accepted for locking or unlocking, while rejecting all other keys with different IDs. The ID consists of an ordered set of pin values, where there are a fixed number of pins having a limited number of possible values for any given lock. The term ID position is also used in reference to a particular position or orientation of certain components, such as the angular orientation of the rotating pins when fully engaged by the key.

Key locks consist of two primary mechanisms: a key identification mechanism, and a latch control mechanism. The key identification mechanism is the part of a key lock that accepts the key inserted by the user, and recognizes whether or not the key has the ID assigned to the specific lock. When the key has the correct ID, the key identification mechanism allows the key to be rotated so as to interface with the latch control. The latch control connects with the key identification mechanism on the backside of the mechanism on most key locks, including this invention. Latches for key locks may be of various types, such as deadbolt latches as typically used on entry doors of homes, or momentary latches as may be used on a cabinet door, or padlock type open/closed hooks, or other. The rotating pin key lock of the present disclosure can be utilized with various kinds of latch controls, including the three mentioned here. Notwithstanding, the term key lock may be used and is generally used herein in reference to a key identification mechanism that is attachable to a latch control mechanism.

When conventional key locks are mentioned herein, it is assumed to be related to those points common to mass marketed locks that use split-pin key identification mechanisms with keys that can be copied in most hardware stores on a key cutter, as are typical of Kwikset, Schlage, Master, and other lock manufacturers' commercial and residential locks. Split-pin IDs typically consist of a set of four to seven pins, with each pin split into two pieces (or sometimes three to accommodate two different key IDs), where the total length of each pin is the same, but the length of the top part of the split-pin and the length of the bottom part of the split-pin varies, typically with three to six possible split length values.

A rake and pick are tools that allow a lock to be unlocked without the correct key by raking over each split-pin with a raking wire while applying rotational force with the pick on the key identification mechanism so as to capture the top of each split-pin in its ID position. A skilled locksmith can use a rake and pick set to open most conventional locks within minutes. This description for picking a lock can often be applied to other types of key locks that do not use split-pin ID mechanisms.

A bump key is a specially cut key designed to allow easy unlocking of a key lock by means of tapping on the bump key while applying a rotating pressure. A bump key transfers the tap from the outside of the key towards the center of the lock, jolting each split-pin simultaneously. The rotating pressure is not so strong as to keep the pins from sliding, but strong enough to snare each top part of the split-pin in its ID position. With minimal training, a person can use a bump key to unlock nearly any lock that the bump key fits. This description can sometimes be applied similarly to key locks that do not use split-pin ID mechanisms.

The present rotating pins key lock invention utilizes single-piece rotating pins instead of the split-pins used in conventional locks. Generally, unless noted otherwise, the discussion about the invention assumes a specific orientation in which the key is inserted into the front of the rotating pins key lock into a substantially vertically oriented key insertion slot, and where a side of the key having ID cut surfaces faces up when the key is inserted. The disclosure generally further assumes and describes a key rotation following insertion that is initially clockwise, and the rotating pins stationed to the right of the key on the inside of the lock. Note that these references to top/bottom, front/back, left/right, and clockwise/counter-clockwise are mostly fixed for this disclosure to minimize ambiguities in the discussion, but can easily be implemented in virtually any combination of orientations.

Figure 2:
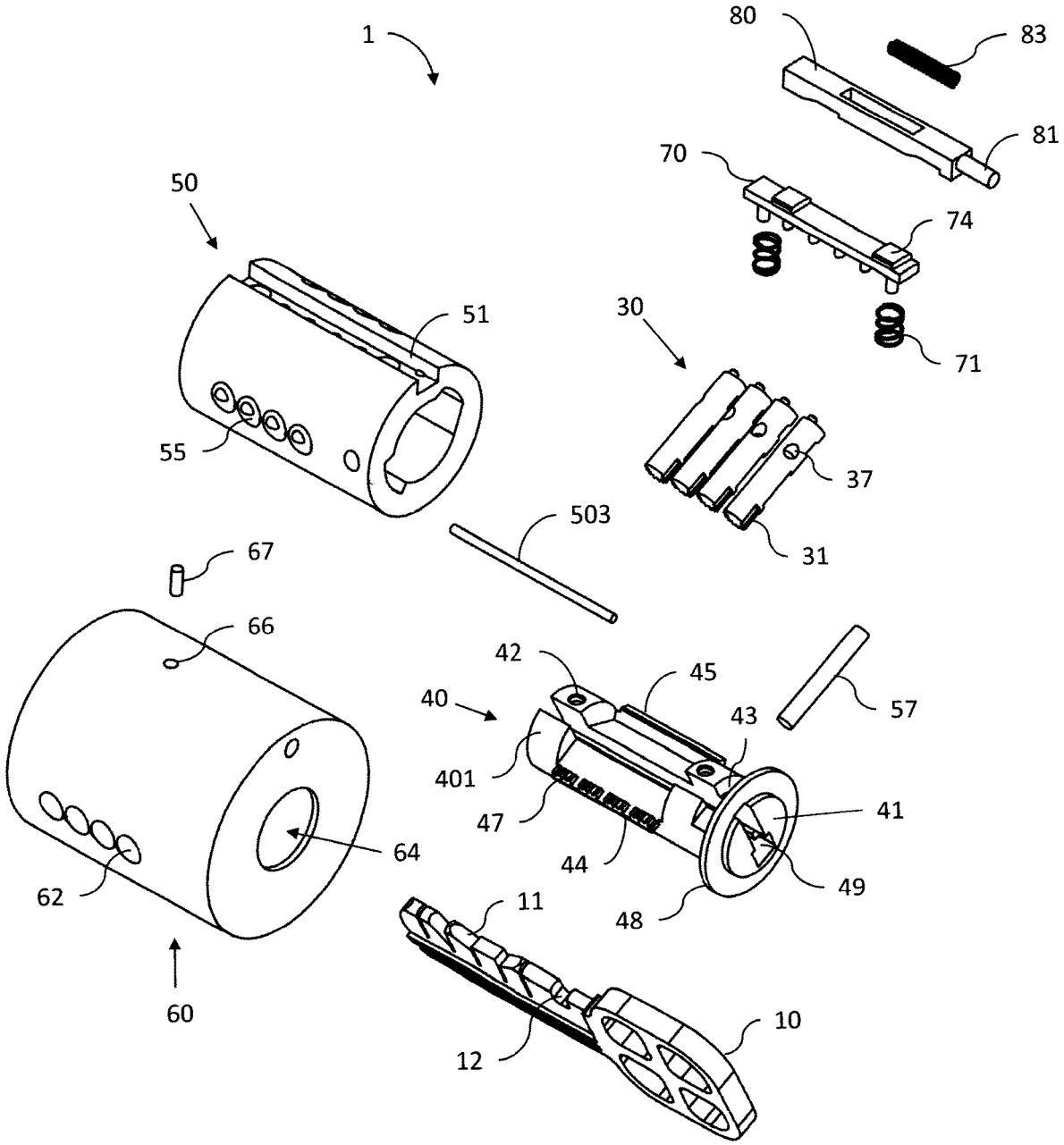

Referring now to the drawing Figures, and initially to FIGS. 1 and 2, an exemplary rotating pin key lock indicated generally at reference numeral 1 includes a key 10, and three nested, generally cylindrical major elements; namely key collar 40, center collar 50, and outer collar 60. The key collar 40 has a front face 41 with optional flange 48, and a key slot 49. The key collar is designed to rotate inside another cylinder, similar in that respect to a key collar of a split pin lock. In the present invention the surrounding cylinder is center collar 50, and unlike the structure around the key collar of a conventional split pin lock however, it is not fixed. Center collar 50 is instead configured to itself be rotatable inside outer collar 60 when a key with the proper ID surfaces and other necessary features is inserted in key slot 49 and rotated. The center collar 50 interfaces with the latch control mechanism (not shown), typically at the back side of the collar, such that the latch control mechanism is operated to latch or unlatch when the center collar 50 rotates. The outer housing 60 is the fixed portion of the nested arrangement, and may include flanges, holes, or other appropriate features not shown here for securing the key lock 1 to a door. For example, in a typical door deadbolt application, a pair of keylocks 1 may be mounted in the usual manner on opposite sides of the door over a bore for the latch mechanism and secured by long bolts extending between the keylocks.

Figure 3:
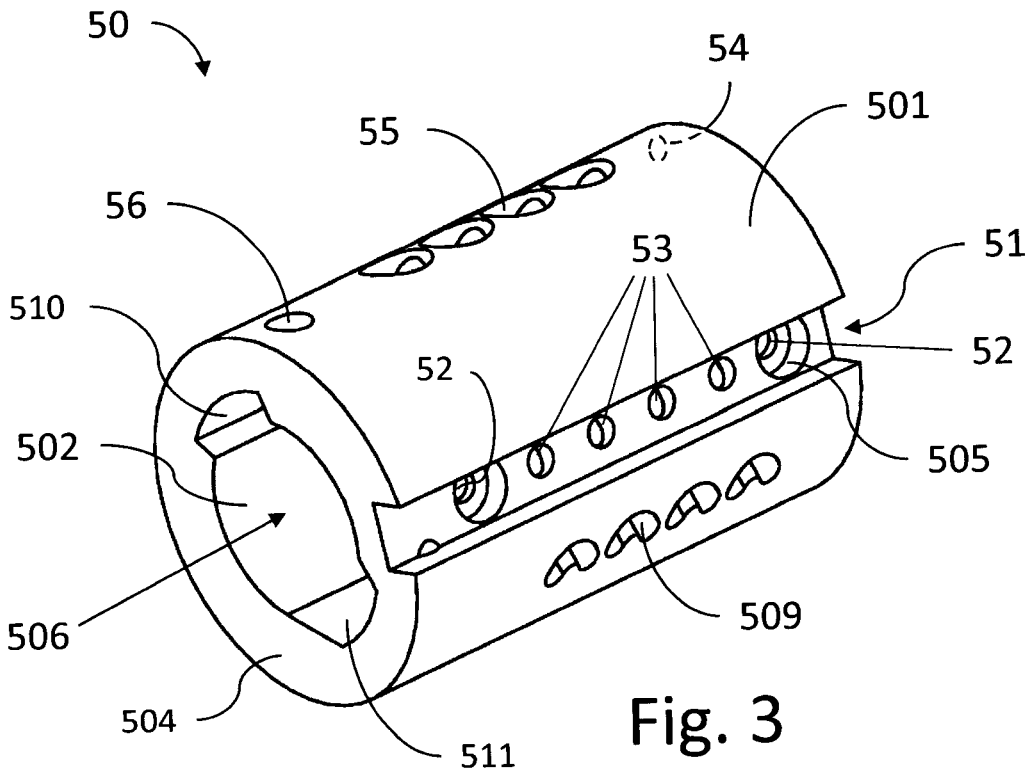
FIG. 3 is a perspective view of the center collar portion of the rotating pin key lock.
Figure 4:
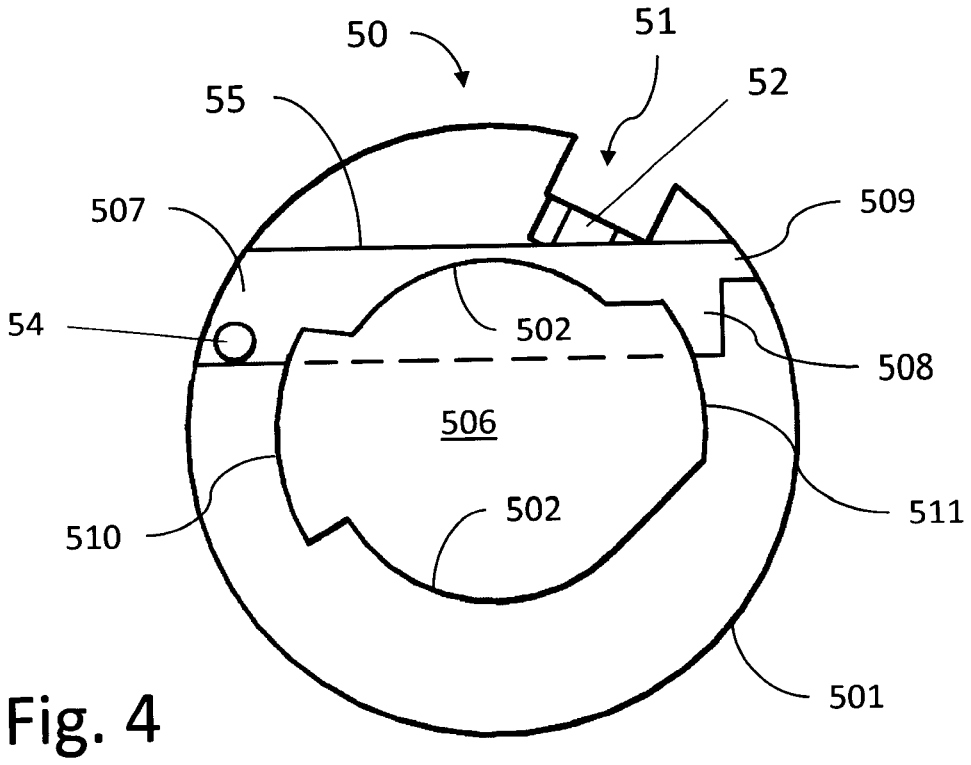
FIG. 4 is a cross-section view of the center collar of FIG. 3 taken through one of a series of rotating pin receiving holes.

Referring now also to FIGS. 3 and 4, the center collar 50 is a hollow cylinder defined by outer and inner cylindrical surfaces 501, 502, where inner cylindrical surface 502 is sized for a close tolerance fit around an outer cylindrical surface 401 of key collar 40. The inner cylindrical surface 502 is interrupted by left and right side arcuate recesses 510 and 511 that longitudinally extend the length of collar 50. The recesses effectively enlarge the center bore of collar 50 on opposite sides over a defined angular distance to provide space for receiving two protruding longitudinal elements of key collar 40, namely pin locking tab 44 and pin homing tab 45.

The outer cylindrical surface 501 of center collar 50 includes a rectangular, longitudinally oriented locking pin slot 51 that extends the length of the collar. At the bottom of slot 51 near each end is a spring recess 505, and a locking pin hole 52 that extends from the bottom of spring recess 505 through the wall of center collar 50. Holes 52 are configured to align with a pair of locking pin receiving holes 42 in key collar 40 when the key collar is rotated within collar 50 all the way clockwise to the key verification position, as will be explained in greater detail below.

Center collar 50 further includes a series of rotating pin receiving holes 55 in the wall of the collar, perpendicular to and offset from a longitudinal axis of collar 50. As can be seen in the cross-section view of FIG. 4, the holes 55 extend from a first end 507 at outer surface 501 along a path that crosses through the center bore of the collar 50 and terminates at a second end 508 within the collar wall on the opposite side. The second end 508 has a flat bottom that may include a crescent shaped recess 509. In one embodiment recess 509 penetrates the outer surface 501 of center collar 50 creating a row of crescent shaped openings visible on the outside of the collar.

The offset of holes 55 from the longitudinal axis of collar 50 is selected such that when the rotating pins 30 are installed in holes 55, a middle region of the pins 30 is exposed within the central bore 506 of the center collar. The dashed line in FIG. 4 indicates the extent to which the paths of holes 55 may extend into or coincide with central bore 506. As will become apparent from the present description, this positioning of the holes makes it possible for the ID cut surfaces of a key 10 to interact with the pins when the key and key collar are rotated.

Referring still to FIG. 3, at the bottom of slot 51 between the locking pin holes 52 is a series of ID locking pin alignment holes 53, one for each rotating pin receiving hole 55. As will be explained further below, holes 53 are positioned to align with a corresponding key ID hole 37 in each rotating pin 30 when the pins are rotated to their respective ID orientations. Center collar 50 further includes a rotating pins retaining rod hole 54 for receiving a retaining rod 503 that extends in a longitudinal direction through the wall of center collar 50, passing through the first ends 507 of each rotating pin receiving hole 55. Retaining rod hole 54 is positioned such that when the rotating pins 30 are installed in their receiving holes 55, the retaining rod may be inserted in hole 54 from the back end of center collar 50 over the rotating pins, trapping them in the center collar.

Figure 5:
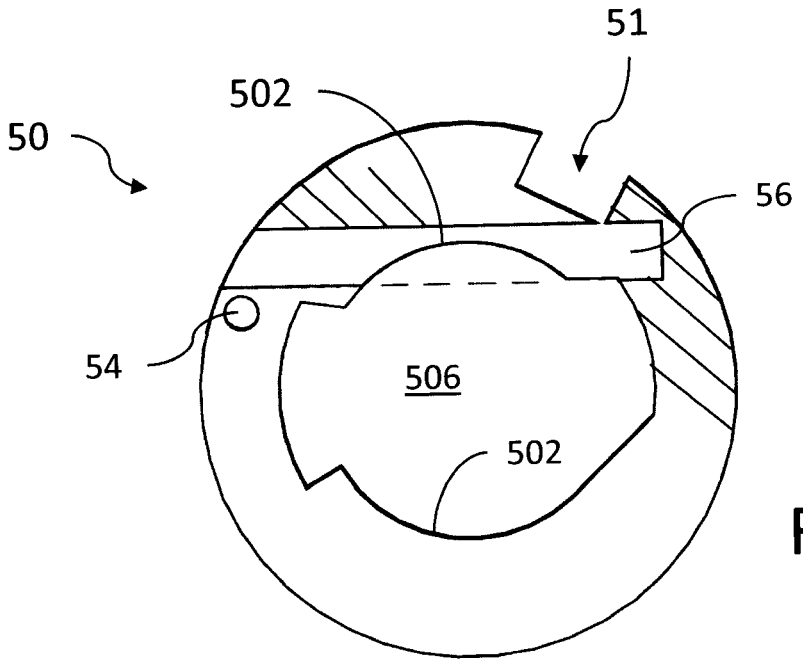
FIG. 5 is another cross-section view of the center collar revealing the key retaining pin receiving hole.
Figure 6:
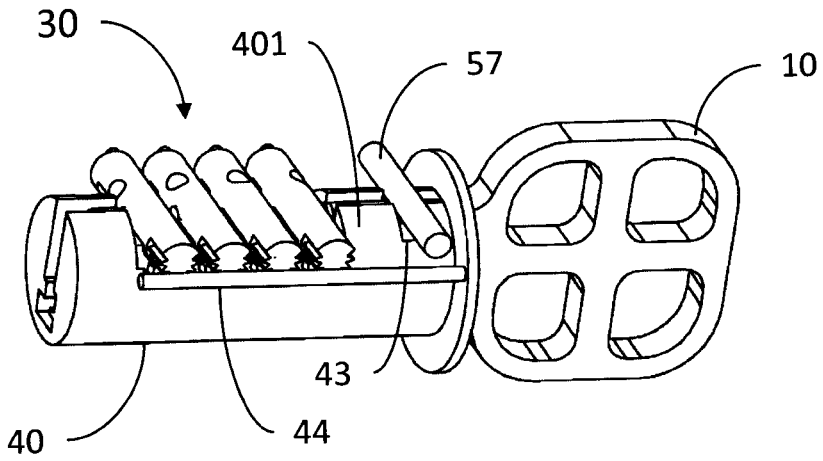
FIG. 6 is a perspective view showing the rotating pins and key retaining pin in functional relation to the key collar and key.

Referring now also to FIGS. 5 and 6, collar 50 may further include a key retaining pin receiving hole 56 for receiving a key retaining pin 57. The key retaining pin receiving hole 56 is located between a front face 504 of collar 50 and the farthest forward rotating pin receiving hole 55, oriented substantially parallel to the rotating pin receiving holes. Hole 56 is also offset from the longitudinal axis of collar 50 by a roughly similar amount to the offset of holes 55, such that the key retaining pin 57 also traverses a portion of the central bore 506 of collar 50, in this case to interact with a retaining groove 12 in the key 10 when the key is rotated. As discussed further below, the key retaining pin 57 acts to precisely position and lock the key 10 longitudinally within the key collar 40 to ensure proper alignment of key with the rotating pins 30. An example of the extent to which retaining pin 57 may protrude into the central bore 506 is indicated by the dashed line in FIG. 5. A locking pin slot 43 in key collar 40 provides clearance so that the key collar can rotate without interfering with retaining pin 57.

Figure 7:
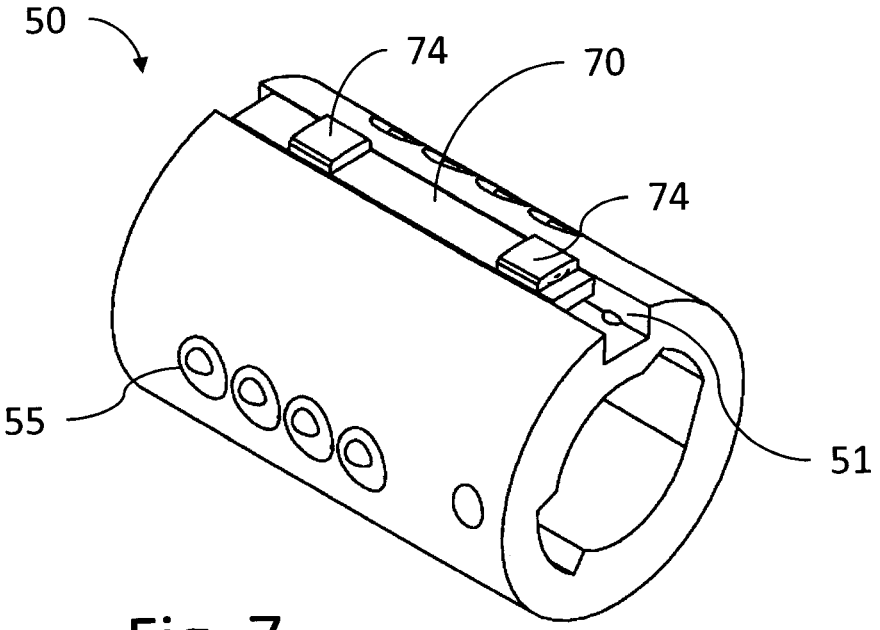
FIG. 7 is a perspective view showing the internal latch disposed within the locking pin slot in the outer surface of the center collar.
Figure 8:
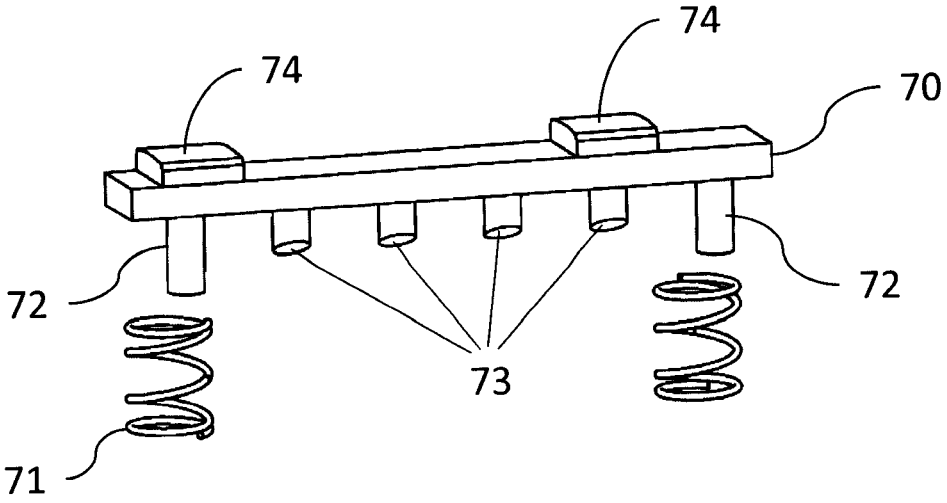
FIG. 8 is a perspective view of the internal latch.

Referring now to FIGS. 7 and 8, an internal latch 70 is disposed in the locking pin slot 51 in outer surface 501 of center collar 50. Internal latch 70 is essentially an elongated bar with one or more outer collar latch tabs 74 on the top surface of the latch, and a series of locking pins projecting from its bottom surface. In the depicted embodiment there are two spaced apart latch tabs 74. The locking pins comprise a pair of key collar latch pins 72, one near each end of latch 70, and a series of beveled ID test pins 73 located between latch pins 72. The key collar latch pins 72 are positioned to align with the locking pin holes 52 at the bottom of slot 51 (see FIG. 3) in center collar 50, and the ID test pins 73 are positioned to align with ID locking pin alignment holes 53. The internal latch is moveable in slot 51 in a direction perpendicular to the longitudinal axis of center collar 50. When the internal latch 70 is seated in the bottom of locking pin slot 51, the pins 72, 73, project through holes 52, 53, and into the central bore 506 of center collar 50. However, internal latch 70 is biased away from the bottom of slot 51 by compression coil springs 71 disposed about the key collar latch pins 72 and seated in the spring recesses 505. The springs 71 must be compressed for the latch 70 to seat at the bottom of slot, and for the pins 72, 73, to project into central bore 506.

The latch tabs 74 are essentially rectangular pads of equal thickness. The thickness is selected such that the top surfaces of the tabs are flush with outer cylindrical surface 501 of the center collar when the latch 70 is seated in the bottom of slot 51. Conversely, if there is a gap between the internal latch 70 and the bottom of slot 51, some portion or all of tabs 74 will project beyond the outer surface 501 of the collar.

Referring now to FIGS. 9 and 10, the outer collar 60 is another hollow cylinder, with outer and inner cylindrical surfaces 601, 602, a front face 604 with a key collar hole 64 and an optional recess 63 on the backside to receive the optional front flange 48 of key collar 40, and a back end 605. The diameters of the inner cylindrical surface 602 of collar 60 and outer cylindrical surface 501 of center collar 50 are selected to produce a close tolerance fit wherein the center collar can freely rotate inside the outer collar without significant play. A series of rotating pin rekey access holes 62 extend through the wall of collar 60. The holes 62 are large enough for rotating pins 30 to pass through, and configured such that the rotating pins 30 can be installed in and removed from the center collar 50, in conjunction with retaining rod 503, without separating the center collar from the outer collar.

Inner cylindrical surface 602 has a latch and key release groove 61 that extends longitudinally rearward from the inside of front face 604 to the back end 605. At the bottom of groove 61 is an exemplary stop pin receiver 66 in the form of a bored hole that extends through the wall of outer collar 60 for holding a spring stop pin 67 (see FIG. 2). At the front end of groove 61 is a pin button hole 68 that extends through the front face 604 of collar 60.

Figure 13:
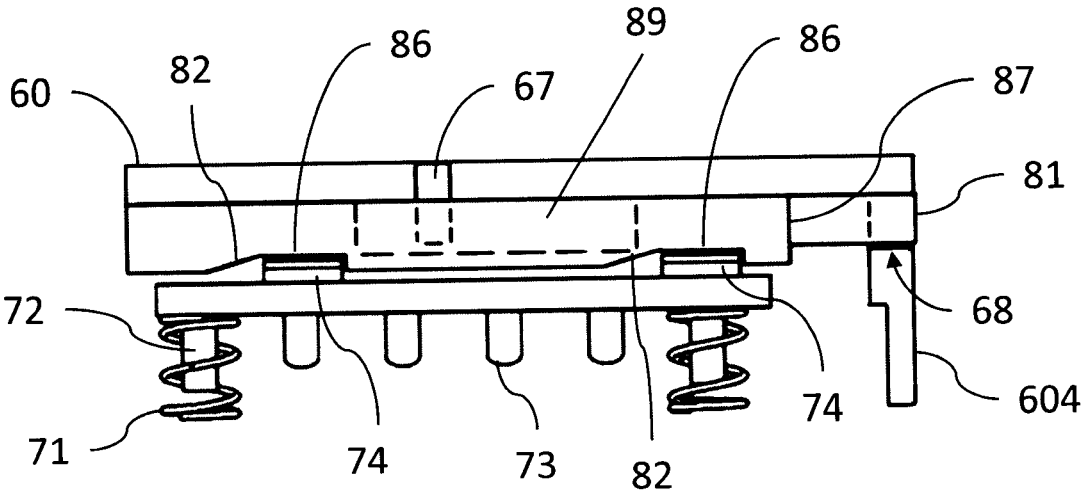
FIGS. 13 and 14 are partial cross-section and cut-away views showing the key release controller and internal latch in their secured and unsecured positions respectively.

Referring to FIGS. 11 through 13, a key release controller 80 in the form of an elongated rectangular bar is configured for a sliding fit inside groove 61 of outer collar 60. Controller 80 has a top surface 84 facing the bottom of groove 61, a bottom surface 85, a front end 87, and a back end 88. Bottom surface 85 may have an arcuate profile matching the curvature of surface 602. The thickness of the release controller, as measured between the top and bottom surfaces 84, 85, is selected such that when the release controller is seated in the bottom of groove 61, the bottom surface 85 of release controller 80 is recessed slightly below flush with the inner cylindrical surface 602 of outer collar 60. This will allow the latch tabs 74 of internal latch 70 to slightly protrude or click into groove 61 when the center collar is in the key verification position, or when attempting to return the center collar to the key verification position prior to removing the key, as discussed in more detail below.

The bottom surface 85 has a pair of notches 86 configured to align with and receive the latch tabs 74 of internal latch 70 when the locking pin bracket slot 51 in center collar 50 is rotationally aligned with release groove 61 in outer collar 60 (in other words when the center collar is in the key verification position). The back edges of the notches 86 have a tapered transition to the bottom surface 85 of controller 80 defining internal latch ramps 82. A face pin 81 extends from the front end of controller 80 into the pin button hole 68 in front face 604 of outer collar 60.

The top surface 84 of release controller 80 has a channel 89 for holding a controller spring 83. The spring 83 is installed in a compressed state between the spring stop pin 67 and the forward end of channel 89. Because the stop pin 67 is fixed in outer collar 60, the controller spring 83 tends to urge the release controller 80 in a forward direction relative to outer collar 60. The amount of forward movement is determined by the space between the back of front face 604 of collar 60 and the front end 87 of controller 80.

Figure 14:
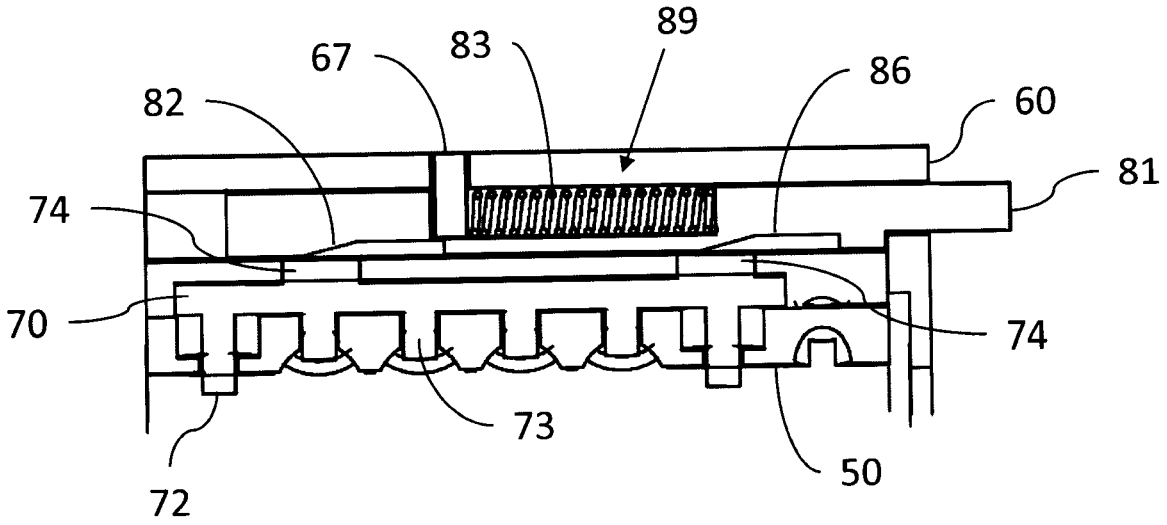

FIG. 14 shows the controller 80 moved forward by controller spring 83 relative to outer collar 60 and internal latch 70. In doing so, the internal latch ramps 82 slide over the latch tabs 74 of internal latch 70, forcing the internal latch to move downward (or radially inward toward a longitudinal axis of the key lock). The controller spring 83 is thus configured to have a high enough spring rate to overcome the springs 71 under internal latch 70, and cause controller 80 to slide forward when latch 70 is otherwise free to move downward toward the bottom of slot 51. As will be explained further below, internal latch 70 is prevented from moving downward except in one set of circumstances that occurs when a key 10 with the proper key ID is inserted and rotated.

Figure 15:
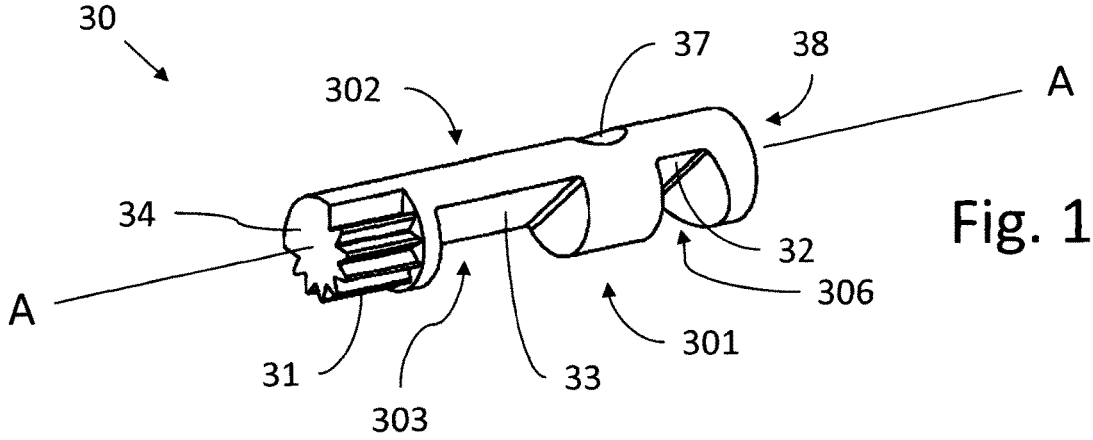
FIGS. 15 and 16 are perspective inner and outer facing views of an exemplary rotating pin.
Figure 16:
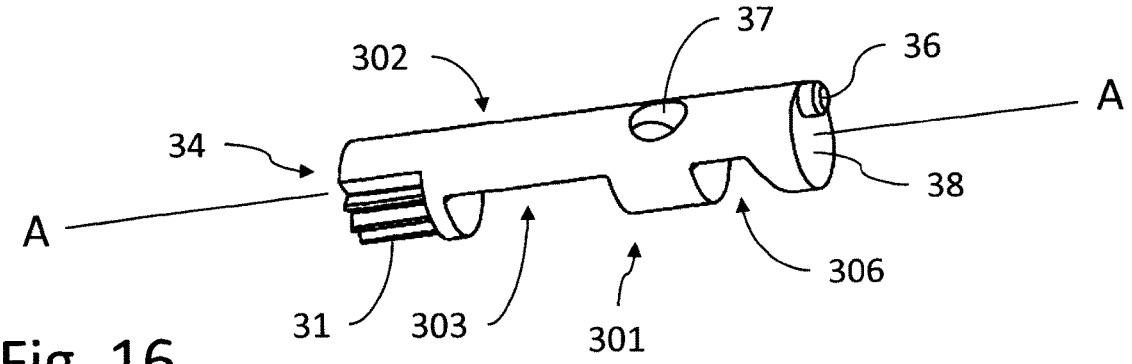

Referring now to FIGS. 15 and 16, a series of cylindrical rotating pins 30 are configured to fit in the rotating pin receiving holes 55 in center collar 50. Pins 30 have a top end 34 with a spline 31, a bottom end 38 with a clocking pin 36, an ID notch 303 in a front side 301 of pin 30 defining a flat ID surface 33, a homing notch 306 also in the inner facing side 301 with a homing surface 32, a key ID hole 37 in an outer facing side 302, and a longitudinal central axis "A". It should be noted that the terms top, bottom, inner, and outer as used here in reference to pin 30 are primarily for convenience and consistency in terminology. Moreover, the angular orientation of the pins 30 changes during operation of the lock, although typically the inner and outer facing sides are mostly facing inward and outward, and the top ends 34 are mostly above the bottom ends 38.

Figure 17:
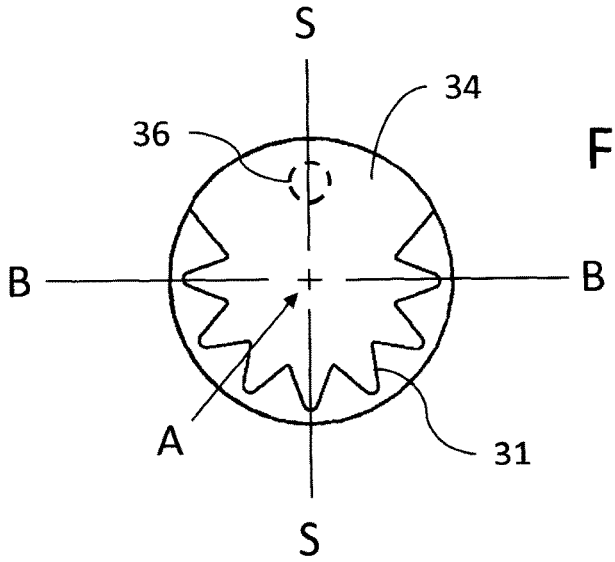
FIG. 17 is an end view of the rotating pin showing the orientation of the spline relative to the pin ID surface and the clocking pin.

Referring now also to FIG. 17, the spline 31 may be a series of evenly spaced teeth formed around the pin, extending downward from the top end 34 (i.e. in a direction from the top end 34 toward the bottom end 38). In one embodiment the spline is symmetrically disposed about a longitudinal plane of symmetry "S" and encompasses between approximately one half and three-fourths of the perimeter of the pin, excluding a portion of the outer facing side 302. The spline teeth may be formed entirely within the pin as shown, such that the tips of the spline teeth are at or below flush with the outer cylindrical surface of the pin. The spline is configured to mate with the pin locking flutes 47 on the locking tab 44 of key collar 40.

The ID notch 303 and surface 33 extend from below the spline 31 toward bottom end 38. ID surface 33 and homing surface 32 may be parallel to each other, and to longitudinal axis A. For example, in the depicted embodiment, a plane B defined by the two surfaces 32, 33, intersects longitudinal axis A, and is perpendicular to plane of symmetry S. In one particular embodiment the clocking pin 36 is centered on plane S, and except for the position of the key ID hole 37, pins 30 are all entirely symmetrical about plane S.

Figure 18:
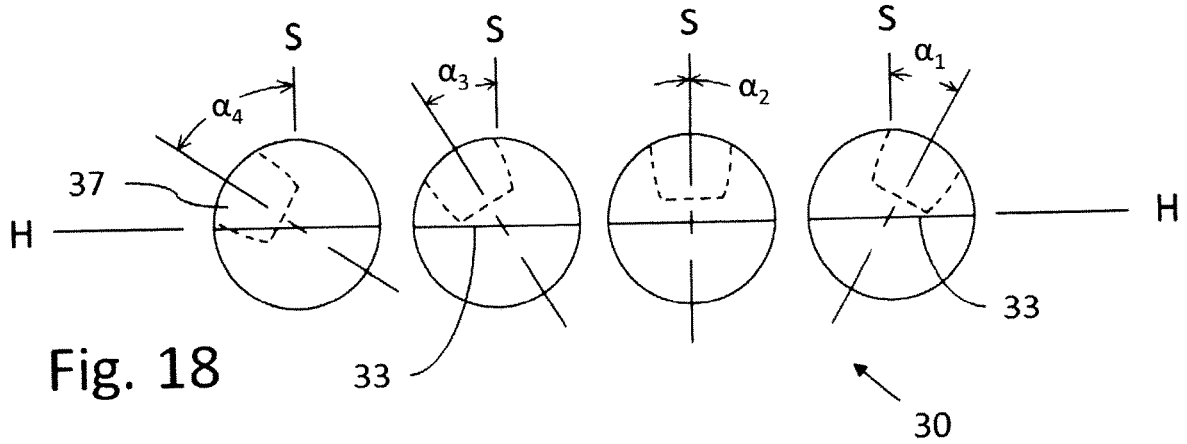
FIG. 18 is a cross section through the series of rotating pins showing the angular orientations of the key ID holes when the rotating pins are all in their home positions.

The key ID hole 37 is located generally on the outer facing side 302 of pin 30, longitudinally between ID notch 303 and homing notch 306. Referring to the cross-section view of FIG. 18, the pins 30 are shown in a home position in which the ID surfaces 33 are all aligned in the same home plane H, parallel to the longitudinal axis of the key lock. It should be noted that although in FIG. 18 and elsewhere four pins 30 are shown, the key lock of the present invention may have more or less than four pins.

As can be seen, the angular positions $\alpha_1$ through $\alpha_4$ of the key ID hole 37, as measured clockwise or counter clockwise from the plane of symmetry S, varies from pin to pin. The angle, referred to here as the rotating pin ID angle, may be a non-zero amount, as in the case of depicted pin ID angles $\alpha_1$, $\alpha_3$, and $\alpha_4$, or zero as in the case of depicted pin ID angle $\alpha_2$. The ID angle may be referred to as positive or negative amount depending upon the direction ID hole 37 is offset from plane of symmetry S.

Figure 19:
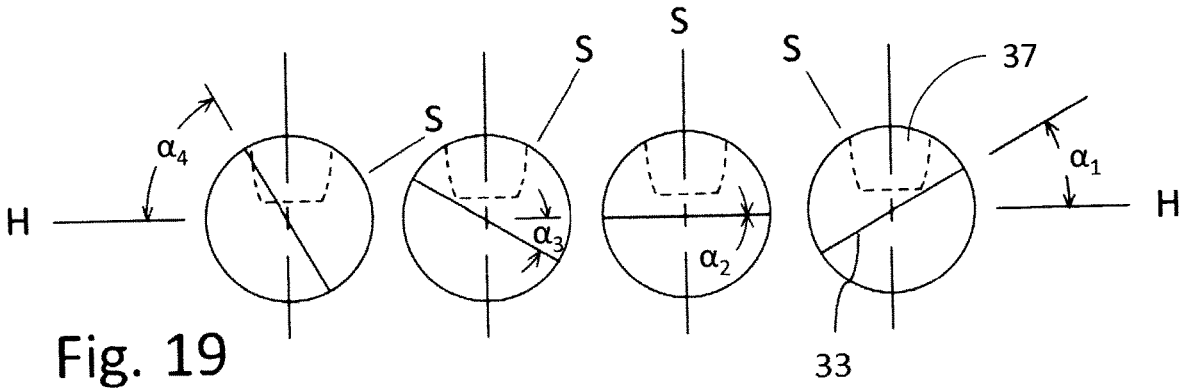
FIG. 19 is another cross section through the series of rotating pins showing the angular orientations of the key ID holes when the rotating pins are all in their ID positions.

FIG. 19 shows the pins 30 in an ID verification condition, where each pin is at its respective ID position, oriented to place the ID hole 37 facing directly outward, or along a line perpendicular to home plane H. In this position the ID holes 37 all align with locking pin holes 52 in center collar 50, and each ID surface 33 is at the respective pin ID angle $\alpha_1$ through $\alpha_4$ relative to the home plane H. As can be seen from comparing FIGS. 18 and 19, the angular orientation of every pin with a non-zero ID angle $\alpha$ changed by moving from the home position to the ID position, and only the pin with an ID hole 37 at a zero ID angle $\alpha$ (angle $\alpha_2$) did not.

As will become better understood below, the ID position of pins 30 shown in FIG. 19 is ultimately achieved by the pin locking flutes 47 mating with the pin splines 31. The possible angular positions of pins 30 is thus a finite number, determined by the angular spacing (or pitch) of the spline teeth. To ensure that the holes 37 can be placed exactly in their ID positions, their angular position must therefore be indexed to the spline teeth, such that each hole 37 is exactly at an ID position when the pin 30 is at one of the finite number of possible angular positions. Accordingly for each of the finite number of possible pin 30 angular positions when mated with locking flutes 47, there is exactly one corresponding angular position of ID hole 37 for the hole to be in the ID position of FIG. 19. The angular spacing between possible angular positions of ID hole 30 is therefore equal to the angular spacing of the teeth of spline 31.

Figure 20:
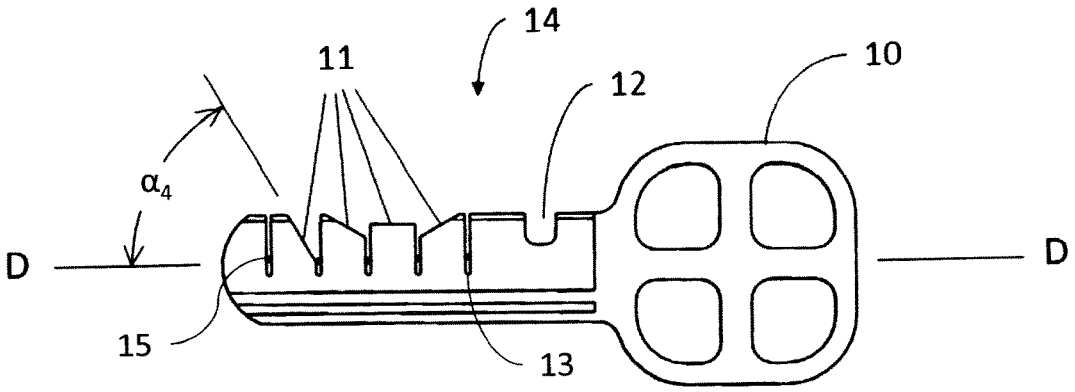
FIG. 20 is a side view of the key showing the ID cut surfaces and key retaining groove.

Referring to FIG. 20, key 10 has an ID side 14 with a series of ID cut surfaces 11, one associated with each rotating pin 30, that define the key ID. The ID cut surfaces 11 are arranged such that when the key is inserted in the key slot 49 of key collar 40, each surface 11 is juxtaposed with an ID surface 33 of a respective rotating pin. The ID cut surfaces 11 are each at a pre-defined angle with respect to a longitudinal axis "D" of the key and key lock, and more specifically at the same ID angle $\alpha$ associated with the corresponding juxtaposed pin 30. The key lock is only operable using a key with this Key ID.

Key 10 may further include a series of optional security grooves 13 positioned between the ID cut surfaces 11, and extending into the key from the ID side 14 perpendicular to axis D. The grooves 13 are arranged to align with a corresponding series of optional security pins 15 in the center collar 50. The pins 15 are positioned in a manner similar to that of key retaining pin 57, in that they are received inside grooves 13 when the key is rotated into the key verification position, and clear of grooves 13 when the key is in the home position.

Figure 21:
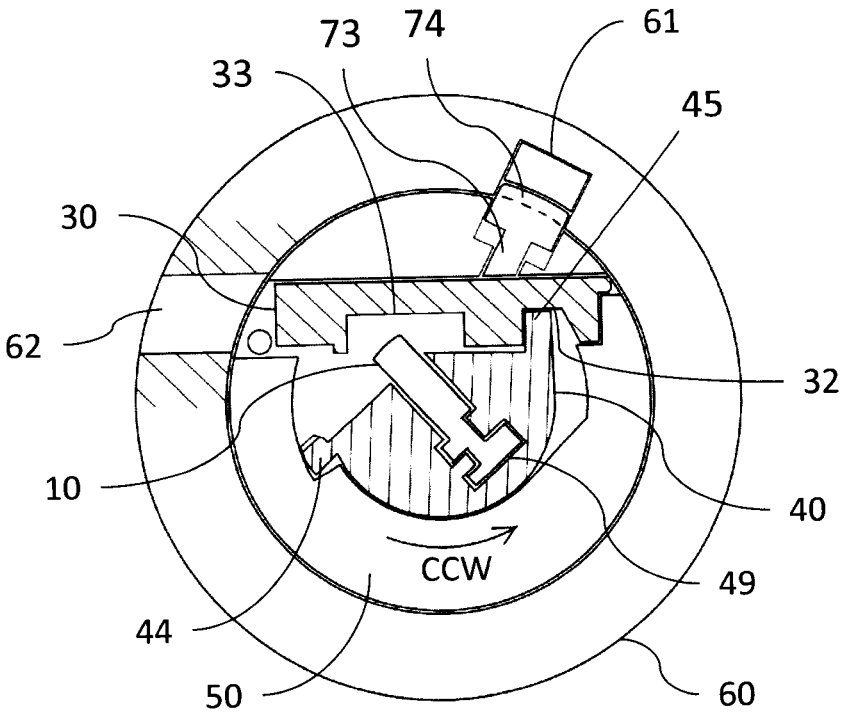
FIG. 21 is a cross sections showing the key lock in the secured condition with the key collar in the home position.

Operation of key lock 1 will now be described, beginning with reference to the cross-section views of FIGS. 21 and 22. FIG. 21 shows the key lock in a secured condition, with the key collar 40 in a home position rotated counter-clockwise within center collar 50 as far as it will go. The rotating pins 30 are in the home position shown in FIG. 18, held there by the homing tab 45 of collar 40 bearing against the homing surfaces 32 of the rotating pins. The key retaining groove 12 of key 10 (not visible in these views) is clear of key retaining pin 57 and any optional security pins 15, and the key is thus free to be inserted and removed from key slot 49.

When the key collar 40 and rotating pins 30 are in their home positions as in FIG. 21, the ID holes 37 of pins 30 are not aligned with the pin alignment holes 53 in the center collar. As a result, the ends of ID test pins 73 of internal latch 70 face the outer facing sides 302 of some or all of pins 30 as shown instead of pin ID holes 37. In addition, the locking pin receiving holes 42 in key collar 40 are not aligned with key collar latch pins 72 of internal latch 70, causing latch pins 72 to bear against the outer cylindrical surface 401 of key collar 40 instead of projecting into holes 42. Note that pins 72 and 73 may be configured such that there is a slight gap between ID test pins 73 and rotating pins 30 when latch pins 72 are in contact with surface 401 of key collar 40. The internal latch 70 is maintained in a raised, also referred herein as secured position by key collar latch pins 72, elevated from the bottom of slot 51, with latch tabs 74 projecting outward into groove 61 of outer collar 60. The center collar 50 is thus rotationally locked, or secured, by the latch tabs 74 to the fixed outer collar 60, preventing any operation of a door latch control mechanism connected to the center collar.

In the raised position shown, the latch tabs 74 also project into notches 86 of key release controller 80. Because the internal latch 70 is being prevented from moving inward by the effective blocking of pins 72, the key release controller 80 is held in the rearward, secured position of FIG. 13, and prevented from sliding forward to the unsecured position of FIG. 14. In addition, because the latch pins 72 of internal latch 70 face the outer cylindrical surface 401 of key collar 40 instead of holes 42, key collar 40 is rotationally unrestrained. Thus, in the secured condition of FIG. 21, while the center collar 50 is rotationally locked in position, the key collar 40 is freely rotatable inside center collar, to the extent allowable by pin homing tab 45 and pin locking tab 44.

Figure 22:
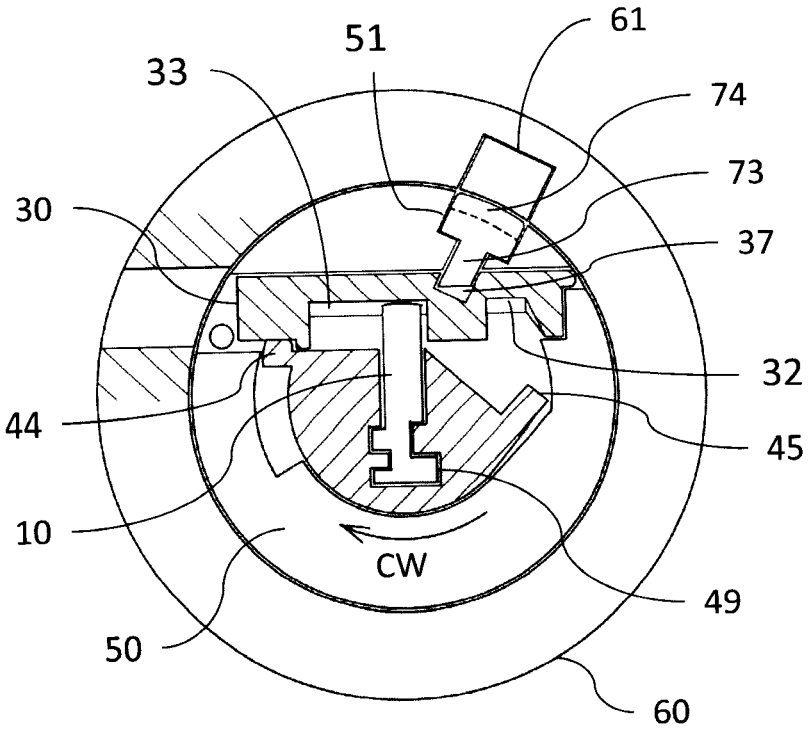
FIG. 22 is a cross sections showing the key lock in the unsecured condition with the key collar in the key verification position.

FIG. 22 shows the key lock with the key collar 40 in a key verification position, rotated clockwise within center collar 50 as far as it will go. As the key and key collar are rotated clockwise from the above described home position toward the key verification position, the homing tab 45 moves away from the homing surfaces 32 of pins 30, leaving the pins unrestrained and free to rotate. With continued clockwise rotation of the key and key collar, the ID cut surfaces 11 of key 10 engage the ID surfaces 33 of pins 30, causing the pins to progressively rotate into alignment with the key surfaces 11. The clockwise rotation simultaneously causes the key retaining groove 12 of key 10 to slide onto the key retaining pin 57, thereby locking the key 10 in a correct longitudinal position relative to key lock, and ensuring alignment of the key ID cut surfaces 11 with the rotating pins 30 as the key rotates into the key verification position.

When the rotation of the key and key collar nears the key verification position, and the pins have rotated substantially into alignment with ID cut surfaces 11, the pin locking flutes 47 on locking tab 44 of key collar 40 begin to engage and mate with the splines 31 on pins 30. As soon as the spline engagement begins, the rotational orientation of the rotating pins 30 is fixed, with the pins locked into their respective ID positions, prior to fully completing rotation of the key collar to the key verification position. Thus the key collar reaches the key verification position after the rotating pins have already been secured in their respective ID positions.

The angles of the ID cut surfaces 11 are selected to ensure that engagement of the locking flutes 47 and splines 31 will occur in each case at the respective one of the finite number of possible pin angular orientations at which the ID holes 37 are in their ID positions. In other words, before the locking flutes 34 reach the splines 31, each pin must be rotationally positioned by the key ID cut surface 11 within an angular range that will ensure the spline and flute engagement happens at the ID position, and not one tooth ahead or behind it. The angle of the key ID cut surface 11 therefore does not have to be perfect but does have to rotationally position spline 31 within an angular spacing between two desired adjacent spline teeth.

When the key collar 40 is in the key verification position and the rotating pins 30 in their ID positions, the key ID holes 37 are all aligned with the ID locking pin alignment holes 53 in center collar 50, and the locking pin receiving holes 42 in key collar 40 are both aligned with the locking pin holes 52 in center collar 50. The obstructions blocking the pins 72 and 73 of internal latch 70 are therefore effectively removed, releasing internal latch 70 to move inward to an unsecured position seated at the bottom of the locking pin slot 51. This may be referred to as key ID verification, and as noted above can only occur after the rotating pins 30 have been secured at their ID positions.

It should be understood however that if the key ID is not correct, at least some of the rotating pins 30 will not be placed in their ID positions. In that case, even though the key collar latch pins 72 are aligned with the locking pin receiving holes 42, at least some of the ID test pins 73 will face the outer facing side 302 of a pin 30 instead of being aligned with an ID hole 37. Consequently, only a slight inward movement of internal latch 70 is possible as the very ends of pins 72 enter holes 42 and the gap between the ends of ID test pins 73 and rotating pins 30 closes, causing some of the pins 73 to then bear against outer facing sides 302, and thereby stop any further inward movement. The ends of pins 72 and/or the edges of holes 42 may be provided with a bevel or chamfer to allow the key collar to be rotated away from the key verification position in this particular situation back toward the home position.

As explained above, the internal latch 70 is biased inward toward its unsecured position by the spring-loaded key release controller 80. The instant that all the pins 30 and key collar 40 reach their ID and key verification positions (using a key with the proper ID), the obstruction provided by the latch tabs 74 of internal latch 70 begins to move away, and the key release controller 80 slides forward to the position shown in FIG. 14 (referred to herein as an unsecured position of key release controller 80). The forward sliding motion causes ramps 82 to push internal latch 70 to the bottom of slot 51, and pins 72 and 73 into holes 37 and 42 respectively, as well as causing face pin 81 to protrude from the outer collar front face 604. The ID test pins 73 thereby rotationally lock the rotating pins 30 in their ID positions, and the key collar latch pins 72 rotationally lock the key collar 40 to the center collar 50.

With the internal latch 70 thus fully seated in slot 51, the latch tabs 74 of internal latch 70 no longer protrude into the latch and key release groove 61 in outer collar 60 (or only slightly protrude due to the slight recess of key release controller 80). Consequently, the center collar 50 is unlocked, or unsecured from outer collar 60 and will remain that way as long as the internal latch 70 is held seated in slot 51. Note that the internal latch may be configured to cause the pins 72 to enter holes 42 and thereby rotationally lock the key collar to the center collar before the latch tabs 74 are completely withdrawn from groove 61 and the center collar becomes unlocked from the outer collar. FIG. 22 shows the key lock in this now unsecured configuration, with the key collar and center collar at the key verification position before (or after) any rotation of the center collar relative to outer collar 60. In this position the bottom surface 85 of key release controller 80 holds the latch tabs 74 below key release groove 61.

If the center collar is subsequently rotated, causing latch tabs 74 to begin moving out from under key release controller 80, the function of holding down latch tabs 74 is taken up by the inner surface 602 of outer collar 60. The center collar may thus be rotated clockwise or counter-clockwise by any amount, with the latch tabs 74 traversing groove 61 freely in either direction for as long as the key release controller 80 is in the forward, unsecured position. The latch tabs 74 may have an arcuate surface matching the curvature of inner surface 602, and beveled side edges to prevent excessive catching on the corner of groove 61. However some slight degree of catching or clicking into groove 61 may be desirable to provide tactile or audible user feedback that the key collar is at the key verification position.

Because the key collar 40 and center collar 50 are locked together in the unsecured condition of the key lock, the center collar can be rotated in the described manner within outer collar 60 by rotating both collars (key collar and center collar) as a unit with the key. The rotation may be used to operate a latch control mechanism of a door latch or lock connected to the back of center collar 50. For example, the door mechanism may be a deadbolt configured so that rotating the key collar and center collar clockwise from the key verification position of FIG. 22 to a stop extends the deadbolt out to a locked position, and a subsequent counterclockwise rotation back from the stop to the key verification position retracts deadbolt to an unlocked position.

In the unsecured condition of the key lock, the key is trapped in the lock by the key retaining pin 57 and any optional security pins 15, as well as the ID surfaces 33 of some of the rotating pins 30. Thus, when the key is being used to operate a door latch or lock mechanism, the key cannot be removed. To remove the key, the key lock must first be returned to the secured condition. This is done by rotating the key collar and center collar to the key verification position (detectable by feel or sound as noted above), then pressing in (toward outer collar front face 604) the extended face pin 81 of key release controller 80. Pressing the face pin 81 in pushes the key release controller rearward back to the position shown in FIG. 13 placing the latch tabs 74 of internal latch 70 under notches 86 of release controller 80 instead of bottom surface 85 and allowing latch 70 to then move outward under the influence of springs 71, once again locking the center collar 50 to the outer collar 60.

At the same time pins 72 and 73 are withdrawn from their respective holes in the rotating pins 30 and key collar 40, leaving the key collar and pins 30 again unrestrained and free to rotate. Note that if face pin 81 were to be released at this point while the key collar is still in the key verification position, the release controller 80 would again spring forward, extending face pin 81, and pushing the internal latch 70 inward.

The key 10 may be removed by rotating the key collar 40 back to the home position of FIG. 21 where the key is clear of key retaining pin 57 and pins 30. Once this rotation toward the home position from the key verification position is initiated, even by the slightest amount, the face pin 81 can be released and will stay retracted. Thus it is not necessary to hold face pin 81 pressed in while the key is rotated back to the home position and removed.

Example Method of Operating the Key Lock:

1. With the key lock in the secured condition, and with key collar 40, center collar 50, and rotating pins 30 in their respective home positions, a key 10 with the proper key ID is inserted into key slot 49 of key collar 40.
2. The key 10 and key collar 40 are rotated to the key verification position. The rotation is clockwise for a lock configured as shown in the drawing figures, or alternatively counterclockwise for a reverse configuration of the key lock to that shown. The rotation to the key verification position rotates and secures pins 30 at their respective ID positions, and subsequently releases internal latch 70 to move inward while key release controller 80 slides forward, unlocking the center collar 50 from outer collar 60 after locking the key collar 40 to center collar 50.
3. The key collar 40 and center collar 50 are rotated as a unit using the key 10 to operate a latch control mechanism for a lock or unlock action. The rotation goes from the key verification position to a stop position of the latch control mechanism, and may be clockwise or counterclockwise as required.
4. The key collar 40 and center collar 50 are rotated in the opposite direction from the stop position back to the key verification position to reverse the previous operation of the latch control mechanism. The key verification position may be identified by touch and/or sound as the latch tabs 74 of internal latch 70 pop slightly into release groove 61.
5. The face pin 81 is depressed, causing the internal latch 70 to spring outward toward key release controller 80, rotationally freeing the rotating pins 30 and key collar 40, and locking center collar 50 to outer collar 60.
6. The face pin 81 is released as the key and key collar are rotated from the key verification position to the home position.
7. The key is removed. Note that face pin 81 will stay in and not pop back out if released after the slightest rotation away from the key verification position has begun. The said rotation immediately moves pin receiving holes 42 in key collar 40 out of alignment with key collar latch pins 72 of internal latch 70, thereby preventing the latch 70 from moving inward, and key release controller 80 from popping out.

There has been described a novel rotating pin key lock apparatus and process with substantially improved ability to resist being opened with a pick or bump key. For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under § 112, 6th paragraph is not intended. Additionally, it is not intended that the scope of patent protection afforded the present invention be defined by reading into any claim a limitation found herein that does not explicitly appear in the claim itself.

What is claimed is:

1. A key lock for operating a latch control mechanism, the key lock comprising:

a key collar with a front face, an outer cylindrical surface, and a longitudinally extending key slot;

a cylindrical center collar concentrically disposed about the key collar such that an inner cylindrical surface of the center collar is fit to and rotatable on the outer cylindrical surface of the key collar, the center collar defining a longitudinal axis of the key lock;

a series of cylindrical rotating pins disposed in the center collar, each rotating pin having a key ID surface configured to engage one of a corresponding series of ID cut surfaces of a key when the key is inserted in the key slot and rotated to a key verification position, thereby rotationally orienting each rotating pin at a respective ID position; and an internal latch configured to rotationally lock the key collar to the center collar when the key and key collar are rotated to the key verification position.

2. The key lock of claim 1, further comprising an outer collar disposed about the center collar, such that an outer cylindrical surface of the center collar is fit to and rotatable within an inner cylindrical surface of the outer collar.

3. The key lock of claim 2, wherein a spacing of the ID cut surfaces along the length of the key is equal to a spacing of the rotating pins, such that each ID cut surface of the key aligns with one rotating pin in a direction perpendicular to the longitudinal axis of the key lock.

4. The key lock of claim 3, wherein the internal latch is an elongated bar disposed in a longitudinally oriented locking pin slot in the outer cylindrical surface of the center collar, the internal latch moveable in a direction perpendicular to the longitudinal axis of the key lock from a secured position in which a portion of the internal latch projects beyond the outer cylindrical surface of the center collar into a longitudinally oriented key release groove in the inner cylindrical surface of the outer collar, to an unsecured position in which the internal latch is seated in the locking pin slot and does not project beyond the outer cylindrical surface of the center collar.

5. The key lock of claim 4, further comprising a series of ID test pins extending from the internal latch through a series of ID locking pin alignment holes in the bottom of the locking pin slot and beyond the inner cylindrical surface of the center collar into a key ID hole in an outer facing surface of each rotating pin when the rotating pins are all in their respective ID positions.

6. The key lock of claim 5, further comprising a key release controller disposed in the key release groove in the outer collar, the key release controller longitudinally moveable when the center collar is in the key verification position between an unsecured position of the key release controller in which the internal latch is prevented from projecting into the key release groove by a bottom surface of the key release controller, and a secured position of the key release controller in which the internal latch is not prevented from projecting into the key release groove by the bottom surface of the key release controller.

7. The key lock of claim 6, wherein the key release controller is biased to move longitudinally forward by a controller spring from the secured to the unsecured position of the key release controller, and the internal latch is biased to move outward from the unsecured to the secured position of the internal latch by latch springs, and wherein the bias force of the controller spring is enough to overcome the latch springs and move the key release controller forward to the unsecured position while simultaneously forcing the internal latch inward to the unsecured position when the rotating pins are all in their ID positions.

8. The key lock of claim 1, further comprising a pin homing tab on the key collar configured to engage a homing surface on each of the rotating pins when the key collar is in a home position, and thereby maintain each rotating pin in a home position.

9. The key lock of claim 8, further comprising a locking tab on the key collar with a series of pin locking flutes configured to engage a spline at a top end of each rotating pin when the key collar is approaching the key verification position.

10. The key lock of claim 9, wherein the homing surface and key ID surface of each rotating pin are both on a plane containing a longitudinal axis of the pin.

11. The key lock of claim 10, wherein the key ID surfaces and homing surfaces of all the pins are on one plane when the key collar is in the home position and the homing tab is against the rotating pin homing surfaces.

12. The key lock of claim 10, wherein the key ID holes of the rotating pins are located on an outer facing side of the pins at a pin ID angle associated with each pin as measured from a line perpendicular to the plane defined by the rotating pin key ID surface.

13. The key lock of claim 1, further comprising a key retaining pin disposed in the center collar and positioned such that the key retaining pin is clear of a retaining groove in the key when the key and key collar are in the home position, and within the retaining groove in the key when the key and key collar are in the key verification position.

14. A method of operating a key lock, comprising the steps of:

inserting a key with a proper key ID into a key slot of a key collar disposed within a cylindrical center collar, wherein the key collar and a series of rotating pins disposed in the center collar are in respective home positions;

rotating the key collar using the key to a key verification position, thereby rotating and securing each rotating pin at a respective ID position, and rotationally locking the key collar to the center collar;

operating a latch control mechanism connected to the key lock using the key to rotate the key collar and center collar as a unit;

returning the key collar to the home position; and removing the key.

15. The method of claim 14, wherein securing each rotating pin at a respective ID position precedes rotationally locking the key collar to the center collar.

16. The method of claim 14, wherein returning the key collar to the home position comprises the steps of:

rotating the key collar and center collar to the key verification position;

unlocking the key collar from the center collar; and rotating the key collar to the home position.

17. The method of claim 16, wherein the step of unlocking the key collar from the center collar further comprises rotationally locking the center collar to an outer collar concentrically disposed about the center collar.

18. The method of claim 17, wherein rotating and securing each rotating pin at a respective ID position comprises engaging an ID surface of each rotating pin with a corresponding ID cut surface of the key as the key approaches the key verification position from the home position.

19. The method of claim 14, wherein the key has an ID side with a series of key ID cut surfaces configured to engage the rotating pins, and a corresponding series of grooves between the ID cut surfaces extending into the key from the ID side, wherein the grooves are configured to engage a series of security pins when the key collar is rotated with the key to the key verification position.

20. A key lock, comprising:

a key collar with a longitudinally extending key slot;

a center collar concentrically disposed about and rotatable on the key collar;

a latch control mechanism functionally connected to the center collar;

a fixed outer collar concentrically disposed about the center collar, wherein the center collar is rotatable within the outer collar; and a series of cylindrical rotating pins disposed in the center collar, each rotating pin having a key ID surface configured to engage one of a corresponding series of ID cut surfaces of a key when the key is inserted in the key slot and rotated to a key verification position, thereby rotationally orienting each rotating pin at a respective ID position.

21. The key lock of claim 20, further comprising an internal latch configured to rotationally lock the key collar to the center collar when the key and key collar are rotated to the key verification position, and the rotating pins are in their ID positions.

22. The key lock of claim 21, wherein the internal latch is an elongated bar disposed in a longitudinally oriented locking pin slot in an outer cylindrical surface of the center collar, the internal latch moveable in a direction perpendicular to a longitudinal axis of the key lock from a secured position of the internal latch in which a portion of the internal latch projects beyond the outer cylindrical surface of the center collar into a longitudinally oriented groove in an inner cylindrical surface of the outer collar, to an unsecured position of the internal latch in which the internal latch is seated in the locking pin slot and does not project beyond the outer cylindrical surface of the center collar.

* * * * *